US006854153B1

(12) United States Patent
Mueller

(10) Patent No.: US 6,854,153 B1
(45) Date of Patent: Feb. 15, 2005

(54) COMPUTER KEYBOARD CLEANER

(76) Inventor: Kenneth C. Mueller, 3 Manorwood, Trabuco Canyon, CA (US) 92679

( * ) Notice: Subject to any disclaimer, the term of this patent is extended or adjusted under 35 U.S.C. 154(b) by 0 days.

(21) Appl. No.: 10/654,707

(22) Filed: Sep. 3, 2003

(51) Int. Cl.[7] ..... A47L 25/00
(52) U.S. Cl. ..... 15/210.1; 15/104.94; 15/231
(58) Field of Search ..... 15/209.1, 210.1, 15/104.94, 228, 229.11, 231, 232

(56) References Cited

U.S. PATENT DOCUMENTS

| | | | | | |
|---|---|---|---|---|---|
| 1,336,044 | A | | 4/1920 | Pennewill | 15/222 |
| 1,595,950 | A | * | 8/1926 | Kirsner | 15/210.1 |
| 1,635,127 | A | | 7/1927 | Kirsner | 15/210.1 |
| 2,414,321 | A | * | 1/1947 | Miller | 15/188 |
| 3,261,049 | A | * | 7/1966 | Murphy | 15/147.2 |
| 4,071,983 | A | * | 2/1978 | Thielen | 451/525 |
| 4,864,677 | A | | 9/1989 | Levy | 15/210.1 |
| 4,975,999 | A | | 12/1990 | Levy | 15/210.1 |
| 5,012,544 | A | * | 5/1991 | Verry | 15/209.1 |
| 5,299,341 | A | | 4/1994 | Wakao | 15/210.1 |
| 5,426,809 | A | * | 6/1995 | Muta | 15/228 |
| 5,461,749 | A | * | 10/1995 | Ahlberg et al. | 15/228 |
| 5,836,034 | A | | 11/1998 | Galvan Garza | 15/118 |
| 5,985,042 | A | | 11/1999 | Fiedler | 134/6 |
| 2002/0133900 | A1 | | 9/2002 | Perkins | 15/320 |

FOREIGN PATENT DOCUMENTS

| | | |
|---|---|---|
| WO | WO 89/09014 | 10/1989 |

* cited by examiner

*Primary Examiner*—Mark Spisich
(74) *Attorney, Agent, or Firm*—Drummond & Duckworth

(57) ABSTRACT

The keyboard cleaner 10 is provided including a plate 22, a plurality of projections 24 that protrude from the plate, and a cleaning pad 30 overlaying the projections. The cleaner is maneuvered manually by a handle 12 fixedly attached to the back side 20 of the plate 22. In operation, the cleaning pad 30 engages the surface of the keyboard 14 keys to remove moisture, dirt and debris. The cleaning pad 30 may be removed to permit the cleaning or replacement of the cleaning pad 30. Additionally, the projections 24 may be impermanently attached to the front side 26 of the plate 22 so that the keyboard cleaner 10 may be modified to match the configuration of virtually any keyboard's surface 14.

9 Claims, 3 Drawing Sheets

COMPUTER KEYBOARD CLEANER

BACKGROUND OF THE INVENTION

The present invention relates to cleaning apparatus. More particularly, the present invention relates to apparatus for cleaning typewriter and computer keyboards.

Until now, no keyboard cleaner has provided an expedient, easy to use, inexpensive structure for cleaning a variety of different keyboards. Moreover, previous cleaning structures have not provided a replaceable cleaning pad for cleaning a keyboard's surface. For example, a known computer keyboard cleaner is described in U.S. Pat. No. 4,975,677. This reference describes a keyboard cleaner including fixed projections that can scrub the surface and side of a key when the cleaner is successfully manipulated by an attached handle. Similarly, U.S. Pat. No. 4,975,999 describes a device which takes advantage of using alternatively-shaped, fixed projections attached to a handle for improved removal of dirt and particles from a keyboard substrate. Neither of the previously described devices, however, utilize projections for engaging a separate cleansing pad which is directed by the projections onto the surface of a keyboard for applying a cleanser or specially adapted cleansing surface. Moreover, these references do not describe a structure capable of cleaning a large number of keyboard keys at the same time.

Meanwhile, U.S. Patent Application Publication No. 2002/0133900 describes a very different and expensive concept for a computer keyboard cleaner. The described device includes an automated vacuum pump attached to a brush for cleaning the surfaces of a computer and keyboard. Another device designed for retrieving dirt from between and under the keys is described in U.S. Pat. No. 5,299,341. The reference describes a device including a multitude of small rotating bristled cleaning attachments, such as circular brushes, which are attached to a vacuum source for collecting dirt.

Yet another computer keyboard cleaner is described in P.C.T. Patent Publication No. WO 89/09014. The device includes a wedge-shaped tool used for wiping keys individually. However, it is not equipped to clean multiple surfaces of keyboards at one time. Still another concept for a keyboard cleaner is described in U.S. Pat. No. 1,336,044, wherein a single cloth having a plurality of strips is described. The strips of the cloth are gently shifted laterally along the rows of keys. In this manner, the tops of the keys are lightly wiped, but the sides of the keys remain relatively untouched. Conversely, several of the previously described cleaning devices are uniquely constructed for cleaning the sides of keyboard keys. However, the areas where fingers come into contact with keys, the top surfaces of the keys, are not adequately cleansed by such devices.

There are general cleaning apparatus, of course, such as that described in U.S. Pat. No. 5,836,034, which include a dual-sided sponge having an absorbent side juxtaposed to a cleaner-infused abrasive side. Cleansing apparatuses, such as this, are not specially tailored for the unique topography of a keyboard having a plurality of convex-shaped keys.

Specialized cleaning apparatuses have also been described for their ability to clean particular items, such as a computer mouse and piano keys. For example, the computer mouse cleaner, described in U.S. Pat. No. 5,985,042, includes a ball having a bristled-surface which is placed into the housing of the mouse. The ball substitutes for the operational ball that typically resides within the housing and enables the mouse to function properly. In operation, the bristled-ball dislodges dirt and grime brought in by the ball during operation and inadvertently lodged inside the housing. Meanwhile, the piano key cleaner, described in U.S. Pat. No. 1,635,127, consists of cleaning pads that are placed onto the surface of the keyboard until pressure is applied to it to depress a key. The sides of the cleaning pads then contact with the sides of the neighboring keys. These pads are used in series to enable cleaning the tops of the depressed keys and the sides of adjacent keys in a single stroke. Several cleaning pads can be used in unison, but this device does not suggest a specially adaptable key cleaner for unique piano key configurations or suggest use of a renewable cleansing cloth.

It should be clear from the above descriptions that a handle and a cleaning surface, alone, are not sufficient for cleaning the particular and specialized surfaces of various computer keyboards. Moreover, previously described keyboard cleaners do not engage the surface of a large number of keys as efficiently as a projection and cleaning pad combination.

SUMMARY OF THE INVENTION

The keyboard cleaner of the present invention includes a plate having a front side and a back side, a handle engaging the plate's back side, a plurality of projections extending from the plate's front side, and a cleaning pad overlaying the projections. The plate may structurally and seamlessly integrate the projections, or, the projections may be temporarily anchored, such as in peg-fashion into a series of holes that grip the base of the projections until the projections are manually removed from the holes.

The projections may be variably sized and spaced to engage the letter keys of a conventional or specialized keyboard. For example, most keyboards include keys spaced at ¾" increments. Accordingly, a preferred keyboard cleaner of the present invention includes projections spaced at ¾" increments. Moreover, in a preferred embodiment, the projections may be removed and rearranged to create a keyboard cleaner specially tailored for the needs of the keyboard cleaner operator. This keyboard cleaner may include any number of rows or any number of projections which are sized and positioned to force the cleaning pad to engage the letter keys of a conventional or specialized keyboard. Preferably, the cleaner includes at least twenty-six (26) projections for engaging the keys of a "QWERTY" keyboard which include at least twenty-six (26) keys corresponding to the 26 letters of the English language.

The keyboard cleaner's projections may have uniform length. However, many keyboards have certain inner rows of keys that extend less than outer rows which usually correspond with number or function keys (sometimes called "macro keys"). To clean such keyboards, the keyboard cleaner of the present invention may include one or more rows of projections that extend slightly more outward than adjacent rows to give the cleaning pad a slightly convex shape. Alternatively, some keyboards include keys in which the center rows extend outwardly beyond neighboring rows. To clean such keyboards, the keyboard cleaner of the present invention may include one or more center rows that do not extend outwardly as far as adjacent rows. Accordingly, the cleaning pad will have a slightly concave shape for engaging the slightly convex shape of the keyboard.

According to a first aspect of the invention, the keyboard cleaner includes a fixed or removable and multi-configurable array of projections having a shape so as to engage the configuration of the keys of a keyboard.

The cleaning pad may also be removable and replaceable for dramatically extending the life of the keyboard cleaner.

The keyboard cleaner of the present invention also can easily be constructed or configured to match a particular keyboard precisely.

Moreover, the keyboard cleaner can clean the many surfaces of the keyboard keys in a single rapid operation.

DETAILED DESCRIPTION OF THE INVENTION

Figure 1:
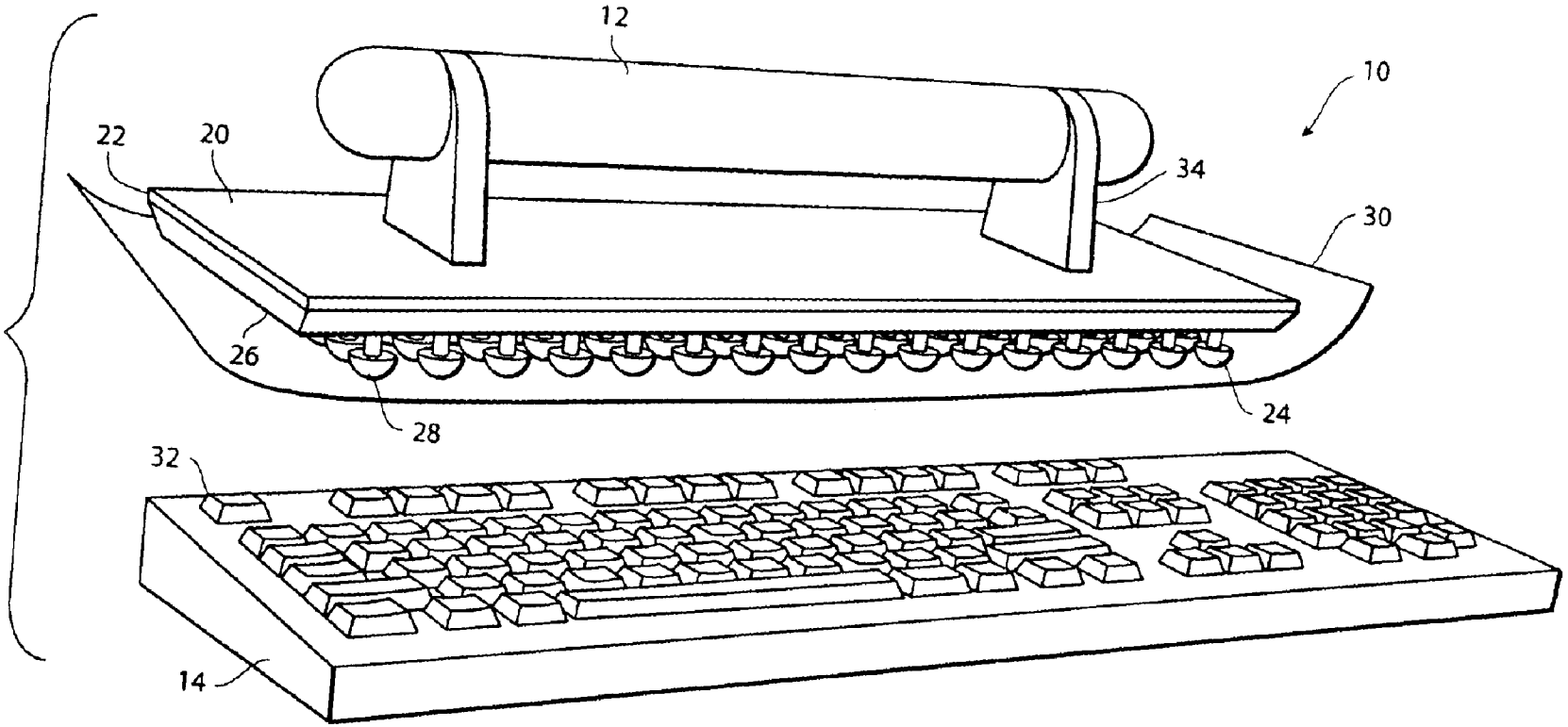
FIG. 1 is a perspective view of the keyboard cleaner of the present invention suspended above a computer keyboard to illustrate the cleaner pad positioned between the cleaner's projections and the keys of the keyboard.

With reference to the figures, the keyboard cleaner 10 of the present invention includes a plate 22 having a front side 26 and a back side 20, a handle 12 engaging the plate's back side, a plurality of projections 24 extending from the plate's front side, and a cleaning pad 30 overlaying the projections. The plate 22 may structurally and seamlessly integrate the projections 24, or, the projections may be temporairly and replaceably anchored, such as in peg-fashion into a series of holes that grip the base of the projections until the projections are manually removed from the holes.

Figure 2:
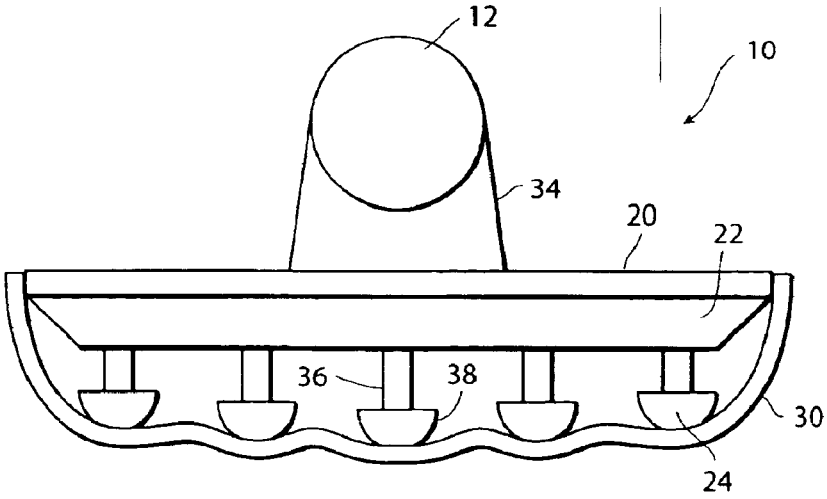
FIG. 2 is a side view of the keyboard cleaner to illustrate the handle, plate, projections and cleaner pad.

With reference to FIG. 2, the handle 12 is attached to the back side 20 of the plate 22 by a supporting structure 34. The supporting structure 34 may be any possible structure that enables the operator to manipulate the handle and keyboard cleaner 10 by hand. Moreover, the handle and supporting structure may be made of any of numerous materials that can be selected by those skilled in the art, such as wood, plastic, metals or composites. Because of the low cost, lightweight, stiffness, and availability, thermoplastics and thermosetting plastics are considered preferable.

As shown in the figures, the plate 22 holds the array of projections 24 that protrude from the front side 26 of the plate 22. The projections 24 may be permanently attached to the plate 22, or, they may be temporarily attached, such as by hook and pile fasteners or in a peg-and-hole fashion. Where the projections are temporarily attached, preferably, the projections can be rearranged or substituted for cleaning different keyboard configurations. For example, the plate may include many more holes than needed for affixing projections for cleaning a conventional keyboard. However, additional holes may be provided in order to rearrange or substitute the projections for keyboards having different key configurations. Though the figures do not illustrate the front side 26 of the plate 22 having holes where projections are vacant, the present invention encompasses a plate having any number of holes allowing projections 24 to be securely attached to the front side 26 of the plate 22.

Figure 3:
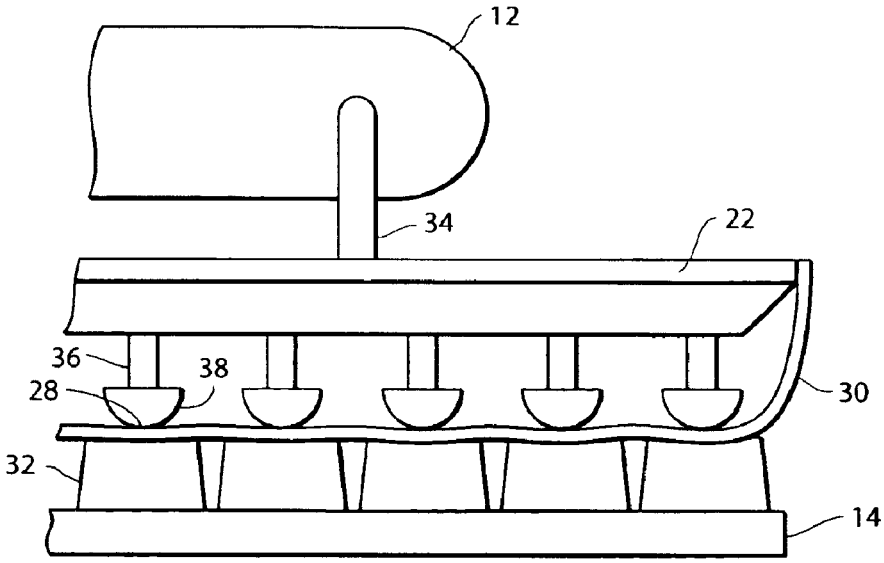
FIG. 3 is a side view of the keyboard cleaner in an operational position wherein convex cleaner projections engage the concave surfaces of keys with the cleaner pad positioned between the projections and keys.

The projections 24 include a stalk 36 and head 38, either of which may take various shapes and sizes. As shown in FIGS. 1–3, in a preferred embodiment, the projections are mushroom-shaped including cylindrically shaped stalks and hemispherically shaped heads. However, these depictions are not intended to limit the possible shapes and sizes of possible projections 24 that can be supported by the plate 22. The projections may also be made of various materials. For example, the projections may be made of relatively hard, substantially non-deformable materials such as wood, plastic or metal. Alternatively, the projections may be made of soft, deformable materials such as sponge or foam.

Preferably, the size and shape of the projections 24 are constructed to maximize their cleaning ability. For example, some keyboard keys have a slightly concave shape. Accordingly, as shown in FIG. 2, a preferred keyboard cleaner of the present invention includes one or more inner rows of projections that extend slightly outward beyond the adjacent rows to provide the cleaning surface of the keyboard cleaner with a slightly convex surface ideally constructed to engage the concave surface of the conventional keyboard. Alternatively, if the keyboard keys provide a convex construction, the center rows of the projections are sized to extend less than adjoining rows, thereby presenting a slightly concave surface for better engagement of the cleaning pad to the keyboard keys.

Figure 4:
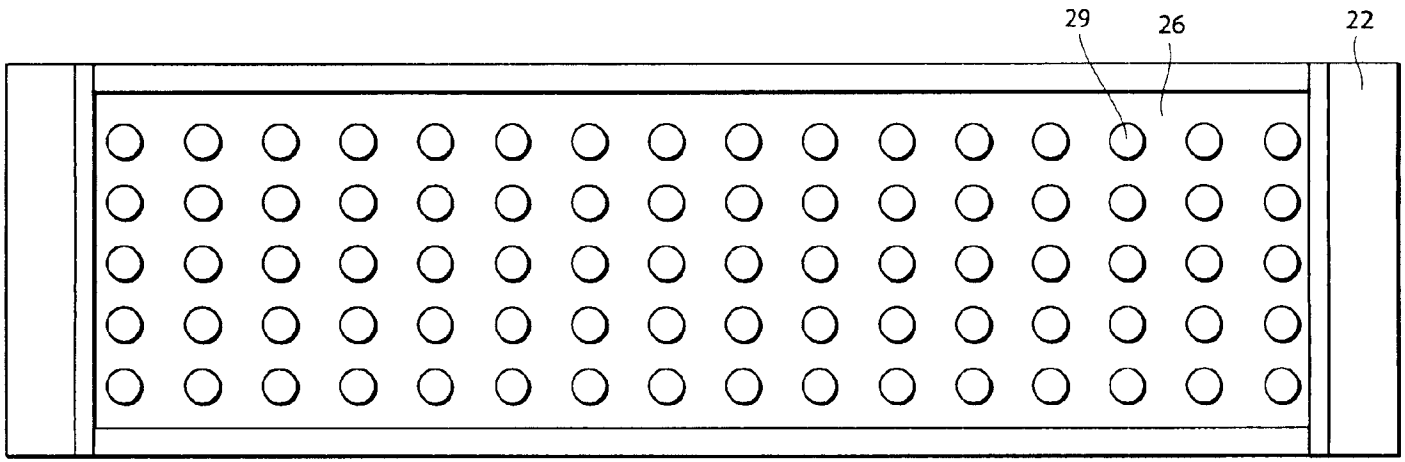
FIG. 4 is a top view of the plate's front side, without a cleaner pad overlaid, illustrating a first particular and specialized configuration of projections having five rows of sixteen keys each.
Figure 5:
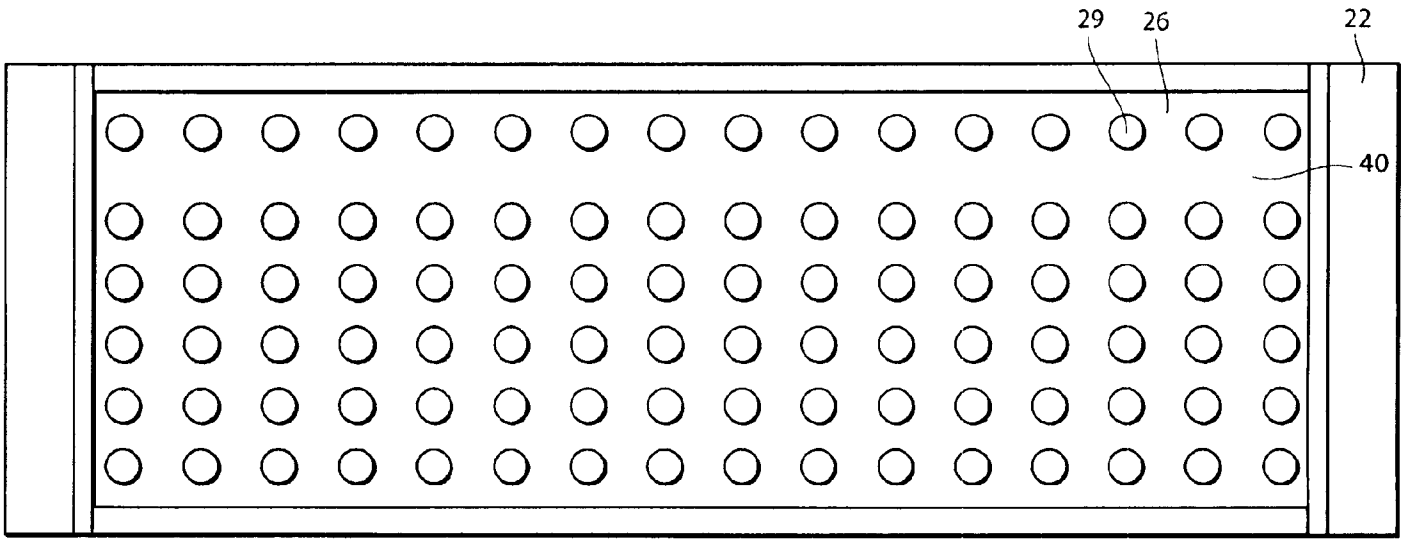
FIG. 5 is a top view of the plate's front side, without a cleaner pad overlaid, having a second particular and specialized configuration of projections having a single row spaced slightly apart from five additional rows, each of which contain sixteen projections.

As shown in FIGS. 4 and 5, the projections 24 are positioned to match the configuration of various keyboard surfaces 14. For example, the keyboard cleaner may include only three rows of projections sized and positioned to engage the letter keys of the keyboard (not shown). In an additional embodiment shown in FIG. 4, the plate 22 may include a larger array of projections 24, such as having five rows of sixteen projections 24. Alternatively, the computer keyboard cleaner 10 of the present invention may be specially adapted to include rows of projections positioned to engage specialty or function keys that are often a feature found slightly apart and at the top of modern computer keyboards. For example, in an embodiment shown in FIG. 5, five similar rows of sixteen projections 24 are set aside from one additional row of sixteen additional projections. The sixth row is set aside by an enlarged space 40 for engaging the traditional "function" keys typically found on a computer keyboard. The configurations shown and described are extremely simplistic variations of the myriad of configurations that are possible. For example, still additional rows may be added for engaging macro keys or keypad keys.

The cleaning pad 30 may be any suitable material for cleaning keyboard keys, including cloth or paper. The cleaning pad may also be saturated with antiseptics, anti-bacterial agents, and cleansers. The cleaning pad is preferably substantially smooth or planar. However, the cloth may including an abrasive or textured surface including substantial ridges or projections for better holding moisture, dirt and debris. As shown in FIG. 1, the cleaning pad 30 may be attached to the plate in a multitude of ways. For example, one skilled in the art may choose to attach the cleaning pad via snaps, rollers, hook and pile fasteners, screws, adhesives, or clips among many other acceptable means for attaching the cleaning pads to the plate 22. Moreover, the cleaning pad 30 may be permanently or impermanently affixed to the plate 22. In an embodiment not shown in the drawings, the keyboard cleaner includes a roller for holding a roll of cleaning pads. As cleaning pads become dirty, the used pad is removed and a new pad is rolled and affixed in place using the existing fasteners.

With reference to FIG. 1, the computer keyboard cleaner 10 operates by lowering the cleaner 10, handle-side up, onto the surface of the keyboard 14. The handle 12 is fixedly attached to the back side 20 of the plate 22 which supports the array of projections 24 on its front side 26. The convex shape 28 of the projections 24 helps to maneuver the cleaning pad 30 over the concave shape 32 of the keys found on a keyboard. With reference to FIG. 3, the keyboard cleaner 10 cleans the keys by coming into contact with the top surface of a keyboard 14. The sides of the keys are cleaned as the cleaner is moved horizontally so that the projections force the cleaning pad downward into the interstitial areas between keys. Because the keyboard cleaner includes a large number of projections, the keyboard cleaner can engage most, or all, of the keys at once and therefore, clean the keys' surfaces efficiently and thoroughly.

Having disclosed my invention in such terms as to enable those skilled in the art to understand and practice it, having identified the presently preferred embodiments thereof, I claim:

1. A keyboard cleaner comprising:

a plate having a front side and a back side;

a handle engaging said plate's back side;

at least three rows of projections extending from said plate's front side including an inner row of projections and a pair of outer rows of projections, said inner row extending outward more than said pair of outer rows to provide a slightly convex configuration so as to engage the slightly concave configuration of the keys of a keyboard, said projections sized and spaced to engage the letter keys of a keyboard; and a cleaning pad overlaying said projections.

2. The keyboard cleaner of claim 1 wherein said cleaning pad is removable and replaceable.

3. The keyboard cleaner of claim 1 wherein said projections are removable and replaceable.

4. The keyboard cleaner of claim 1 wherein said cleaner includes at least five rows of projections, with said projections of the three middle rows sized and positioned to engage the letter keys of a keyboard.

5. The keyboard cleaner of claim 4 wherein said cleaning pad is removable and replaceable.

6. A keyboard cleaner comprising:

a plate having a front side and a back side;

a handle engaging said plate's back side;

at least twenty-six (26) projections extending from said plate's front side including at least three rows of projections including an inner row of projections and a pair of outer rows of projections, said inner row extending outward more than said pair of outer rows to provide a lightly convex configuration so as to engage the slightly concave configuration of the keys of a keyboard, said projections sized and spaced to engage the letter keys of a keyboard; and a cleaning pad overlaying said projections.

7. The keyboard cleaner of claim 6 wherein said cleaning pad is removable and replaceable.

8. The keyboard cleaner claim 6 wherein said cleaner includes at least five rows of projections, with said projections of the three middle rows sized and positioned to engage the three rows of letter keys on a keyboard.

9. The keyboard cleaner of claim 8 wherein said cleaning pad is removable and replaceable.

* * * * *